United States Patent [19]

Kot, II

[11] Patent Number: 4,482,049

[45] Date of Patent: Nov. 13, 1984

[54] MAGNETIC DRILL HOLDER

[76] Inventor: Norbert J. Kot, II, 3278 N. Shepard Ave., Milwaukee, Wis. 53211

[21] Appl. No.: 568,046

[22] Filed: Jan. 4, 1984

[51] Int. Cl.[3] ..... B65D 85/24; B65D 85/62

[52] U.S. Cl. ..... 206/379; 206/350; 206/373; 206/443; 206/818; 211/60 T; 248/309.4; 224/183

[58] Field of Search ..... 206/379, 350, 813, 373, 206/443; 211/60 T; 248/206 A

[56] References Cited

U.S. PATENT DOCUMENTS

| | | | |
|---|---|---|---|
| 361,248 | 4/1887 | Winton | 211/60 T |
| 2,164,623 | 7/1939 | Posner . | |
| 2,176,052 | 10/1939 | Beyer | 206/818 |
| 2,641,793 | 6/1953 | Wilm | 16/116 |
| 2,667,394 | 1/1954 | Goetz et al. | 312/73 |
| 3,007,568 | 11/1961 | Kurland | 206/350 |
| 3,233,802 | 2/1966 | Ludwick | 224/183 |
| 3,248,167 | 4/1966 | Friedman | 206/350 |
| 3,315,799 | 4/1967 | Booker | 206/818 |

*Primary Examiner*—William T. Dixson, Jr.
*Attorney, Agent, or Firm*—Fuller, House & Hohenfeldt

[57] ABSTRACT

A magnetic drill holder is comprised of a nonmagnetic housing and a magnetic back plate. The housing is fabricated as a series of adjoining longitudinal channels, each having one closed end. A common magnetic back plate encloses the channels longitudinally, thus forming longitudinal receptacles. The channels may be of varying lengths and areas, making them suitable for holding a series of tools, such as drill bits. Magnetic tools placed in the receptacles are retained in them by magnetic attraction. The tool holder further includes a pocket that utilizes the magnetic back plate and a housing rib to hold a selected tool, such as a drill chuck key, in the tool holder.

7 Claims, 4 Drawing Figures

MAGNETIC DRILL HOLDER

BACKGROUND OF THE INVENTION

1. Field of the Invention

This invention pertains to storage apparatus, and more particularly to magnetic apparatus for holding and storing small acticles.

2. Description of the Prior Art

It is well known to employ magnets to hold magnetic material in desired locations. U.S. Pat. Nos. 2,164,623; 2,176,052; 2,641,793; 2,901,804 and 3,007,568 provide examples of devices that utilize one or more magnets to perform holding functions. U.S. Pat. No. 361,248 describes several applications of two or more magnets cooperating to hold metallic articles such as needles and small tools. A drawback of the holders of the U.S. Pat. No. 361,248 is that the stored articles lie exposed on the magnets, thus making them prone to be accidently knocked off the magnets, expecially if the holders are moved about from job to job. A strap or eye for suspending the holders on nails emphasizes non-portability. Further, the stored articles are not separated from each other in an organized manner, thereby making it difficult and cumbersome to remove one article without disturbing adjacent ones. This is particularly true in the case of small closely spaced articles, such as needles.

U.S. Pat. No. 2,667,394 discloses a dispenser for articles of magnetic material, such as needles. The dispenser includes a magnetic carrier that slides within a case to project the needles out of the case and to withdraw them from view into the case. A disadvantage of the dispenser of the U.S. Pat. No. 2,667,394 is that only the tips of the stored needles are subjected to the magnetic holding force. Thus, the needles are likely to fall out of the dispenser if it is turned sideways or upside down, and they almost certainly will fall out if the dispenser is jarred when in those attitudes. Further handicaps of the dispenser include the requirement that the needles or other articles have approximately equal lengths, and the expense of machining and assembling the several parts that comprise the case and movable magnetic carrier.

U.S. Pat. No. 3,315,799 teaches a commuter ticket holder having a magnet that enables the holder to be placed on a metal structure. The magnet extends through the base piece and is flush with the front side of the ticket holder base piece and protrudes slightly behind the base piece back. The commuter tickets, being nonmetallic, are retained in the holder by a fixed clip and a sliding clip and not by the magnet. It is apparent that the holder of the U.S. Pat. No. 3,315,799 is limited to holding articles shaped as thin flat sheets of approximately equal size, and that the holder is not intended for holding magnetic articles.

Thus, a need exists for a portable and inexpensive magnetic holding device that securely holds a number of different sized metallic articles while providing ready and convenient access to the stored articles.

SUMMARY OF THE INVENTION

In accordance with the present invention, a portable magnetic holder is provided for holding several different sized articles in an inexpensive and convenient manner. This is accomplished by apparatus which includes a magnetic back plate in combination with a housing having several three-sided longitudinal channels which are closed on one end. The common back plate forms a fifth side of the housing channels, thereby creating several individual magnetic receptacles for receiving the magnetic articles to be stored.

The housing channels define substantially square cross sections. In the preferred embodiment, the sides of the channels vary in length and area, so that articles of different lengths and cross sections, such as a set of drill bits, can be held therein. The housing channels are arranged side by side, so that two adjacent channels share a common wall. The open ends of the channels preferably lie in a common plane, so that the closed ends of the channel define a stepped outline. The housing may be fabricated from any suitable non-metallic material.

The magnetic back plate may be joined to the housing by any appropriate method. The back plate is preferably manufactured from a flexible magnetic strip, as that material is convenient to work with and does not damage the tools. Thus, the non-metallic housing and magnetic back plate cooperate to form tool holding receptacles, and, since the tools contact the back plate along their entire lengths, the back plate further serves to retain the tools in the holder even if the holder is turned upside down and jarred.

Further in accordance with the present invention, the housing and magnetic back plate cooperate to hold a drill chuck key. For that purpose, the housing includes a pair of border strips which lie in the same general plane as the channels. The border strips intersect to define a generally triangular opening between the border strips and channel closed ends. The housing is also fabricated with a rib that extends from a border strip to a channel end wall. The rib contains a slot.

In addition to enclosing the longitudinal housing channels, the back plate further spans the opening defined by the stepped closed channel ends and the border strips, thus forming a pocket. The back plate also encloses the rib slot. The pocket is sized to receive a conventional drill chuck key, which is inserted into the rib slot and placed against the back plate, where it is securely held.

To provide versatility in transporting and storing the tool holder of the present invention, the housing preferably includes a pair of hooks for carrying the holder in a belt or pants loops. Additionally, the back plate projects a slight distance from the housing so that the tool holder may be conveniently placed on vertical metallic surfaces.

Other objects and advantages of the invention will become apparent to those skilled in the art from the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
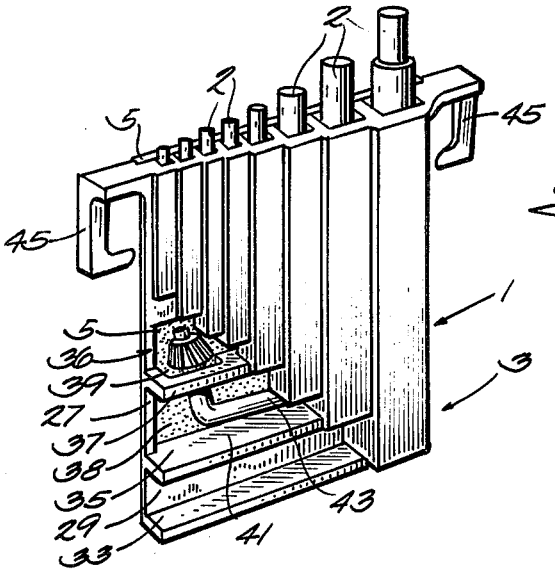
FIG. 1 is a perspective view of the magnetic drill holder of the present invention.

Referring to FIG. 1, a magnetic tool holder 1 is illustrated that includes the present invention. The tool holder finds particular usefulness for holding and storing small drill bits 2, but it will be understood that the invention is not limited to retaining hardware articles.

Figure 2:
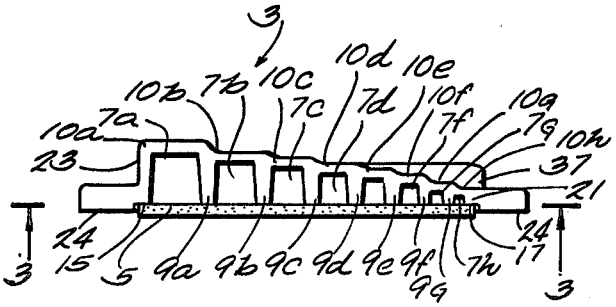
FIG. 2 is a top view of the magnetic drill holder of the present invention.
Figure 3:
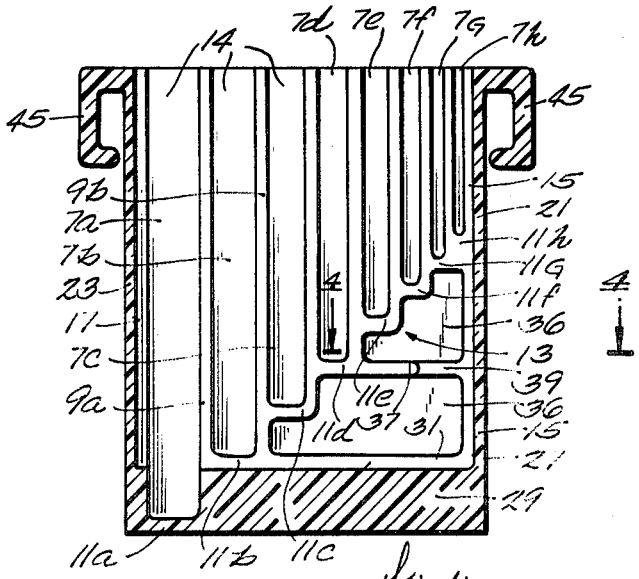
FIG. 3 is a sectional view taken along lines 3—3 of FIG. 2.

The tool holder 1 is formed through the cooperation of a suitably shaped non-magnetic housing 3 and a substantially flat magnetic back plate 5. As best illustrated in FIGS. 2 and 3, the housing is fabricated as a series of adjoining U-shaped longitudinal channels 7(*a*)–7(*h*). Adjacent channels share a common side wall, such as at 9(*a*)–9(*g*). Each channel is also bounded by a front wall 10(*a*)–10(*h*). The channels defined by the side and front walls are approximately square in cross section, and they preferably vary sequentially in size to suit a range of drill bits. For example, the side and front walls may define square channels having sides of from about 0.520 inches at channel 7(*a*) to about 0.082 inches at channel 7(*h*).

The housing 3 includes transverse end walls 11(*a*)–11(*h*), FIG. 3, which close one end of the channels 7(*a*)–7(*h*), respectively. The length of the channels, as defined by the end walls, are in proportion to the channel cross sections. Thus, channel 7(*a*) may be about 4.56 inches long and channel 7(*h*) may be about 1.54 inches long. As readily seen from FIG. 3, the channel end walls 11 create a stepped surface 13.

In accordance with the present invention, the channels 7(*a*)–7(*h*) are longitudinally enclosed on a fifth side by a generally rectangular magnetic back plate 5, thus creating a series of elongated receptacles having planar openings 14. The preferred material of the back plate is a flexible permanent magnetic strip such as is sold by Bunting Magnetics Company under the trademark "Plastiform". That material is relatively soft so that it does not nick or dull tools stored in the tool holder 1. Drill bits 2 inserted in the receptacles have substantially continuous contact with the common back plate. Consequently, the drill bits are securely retained within the receptacles. The length of the channels 7(*a*)–7(*h*) are proportioned so that commercially available drill bits protrude slightly from the open ends 14, thus permitting ready access to the drill bits, FIG. 1.

Figure 4:
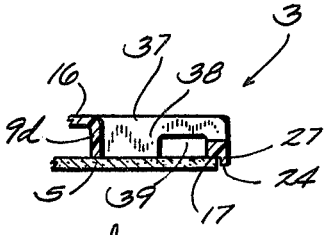
FIG. 4 is a sectional view taken along lines 4—4 of FIG. 3.

The back plate is preferably received within steps 15 and 17 formed in housing outside walls 21 and 23, respectively. The bottom surfaces of steps 15 and 17 are coplanar with the ends of walls 9(*a*)–9(*g*). To permit placement of the tool holder 1 on a vertical or sloped magnetic surface, the back plate is slightly thicker than the depth of steps 15 and 17, and thus protrudes beyond the housing back surface 24, FIGS. 2 and 4. The back plate may be fastened to the housing by any suitable material, such as an adhesive applied to the end walls 9(*a*)–9(*h*) and along steps 15 and 17.

To provide further versatility to the tool holder 1, the housing 3 may be formed with a pair of hooks 45 which are adapted to fit over the user's belt or pants belt loops. The housing may be manufactured from any appropriate non-magnetic material and by any compatible method. For example, the housing may be manufactured from a thermosetting plastic by an injection molding process.

Further in accordance with the present invention, the housing 3 is fabricated with a pair of intersecting border strips 27 and 29. The border strips, together with stepped surface 13, define an opening 36 in the plane of the channels. Border strip 27, which is relatively narrow, may be considered to be an extension of outside wall 21, and the step 15 is continuous between outside wall 21 and border strip 27. Border strip 29, which is relatively wide, is perpendicular to border strip 21. It will be noted that end wall 11(*a*) is formed as a part of border strip 29, FIG. 3. Step 31 in border strip 29 is continuous with steps 15 and 17. To provide strength and rigidity to border strip 29, it may include a pair of upstanding gussets 33 and 33, FIG. 1.

As shown in FIGS. 1, 2 and 3, the back plate 5 covers the opening 36 between the steps 13 and the border strips 27 and 29, thus creating a pocket 38. The housing 3 further includes an upstanding rib 37 extending between border strip 27 and a channel end wall, such as end wall 11(*d*). The rib divides the opening 36 in two. The rib defines a slot 39 which is bounded on one side by the back plate 5, FIGS. 1–4, thus forming an aperture through the rib. The illustrated construction is eminently useful for holding and storing a conventional chuck key 41 within the pocket 38. By inserting the key straight leg 43 through the slot 39 and placing the key flat on the back plate, the tool holder magnetically retains the key securely in place. Gusset 35 and one or more end walls 11 or side walls 9 may also contribute to retaining the key.

Thus, it is apparent that there has been provided, in accordance with the invention, a magnetic drill holder that fully satisfies the object, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A magnetic tool holder for holding and storing a plurality of magnetic tools comprising:

(a) a housing having a plurality of adjoining generally U-shaped longitudinal channels, each channel being defined by a pair of spaced side walls, a top wall, and a transverse end wall; and (b) a magnetic back plate attached to the housing to longitudinally enclose the channels to create a plurality of open ended elongated receptacles, so that magnetic tools inserted into the receptacles are retained in place by the common magnetic back plate.

2. The magnetic tool holder of claim 1 wherein the longitudinal tool holding receptacles are of different areas and lengths to accommodate a variety of tool cross sections and lengths.

3. The magnetic tool holder of claim 2 wherein the tool holding receptacles are arranged sequentially by size to accommodate a range of drill bits.

4. The magnetic tool holder of claim 3 or claim 2 wherein the tool holding receptacle open ends are coplanar, so that the channel end walls and side walls create a stepped surface.

5. The magnetic tool holder of claim 4 wherein:

(a) the housing further comprises:

i. a pair of intersecting border strips formed integrally with and extending from the U-shaped channels to enclose the stepped surface and to create an opening in the plane of the channels; and ii. a rib formed integrally with and extending between a border strip and a U-shaped channel and defining a slot therein; and (b) the magnetic back plate covers the housing opening in the plane of the channels to create a pocket and to enclose the rib slot thereby forming an aperture through the rib, so that a selected magnetic tool may be inserted through the rib slot and placed within the pocket and against the magnetic back plate for secure retention.

6. The magnetic tool holder of claim 5 wherein:

(a) the channel side walls end in a common plane;

(b) the housing is formed with a pair of outside walls having a back surface;

(c) the border strips have a back surface coplanar with the outside walls back surface;

(d) the outside wall and the border strips are formed with stepped surfaces coplanar with the ends of the channel side walls; and (e) the magnetic back plate is received in the steps in the outside walls and border strips, the magnetic back plate being thicker than the depth of the steps, so that the magnetic back plate protrudes beyond the back surfaces.

7. The magnetic tool holder of claim 1 or claim 6 wherein the housing further comprises at least one hook adapted to engage the user's belt or pants belt loop.

* * * * *